US006740478B2

(12) United States Patent
Nishio

(10) Patent No.: US 6,740,478 B2
(45) Date of Patent: May 25, 2004

(54) METHOD FOR PROCESSING SILVER HALIDE LIGHT-SENSITIVE PHOTOGRAPHIC MATERIAL

(75) Inventor: Shoji Nishio, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/360,351

(22) Filed: Feb. 7, 2003

(65) Prior Publication Data

US 2003/0165783 A1 Sep. 4, 2003

Related U.S. Application Data

(62) Division of application No. 09/962,648, filed on Sep. 25, 2001, now abandoned.

(30) Foreign Application Priority Data

Sep. 28, 2000 (JP) ..... 2000/296164

(51) Int. Cl.[7] ..... G03C 5/30
(52) U.S. Cl. ..... 430/440; 430/446; 430/465
(58) Field of Search ..... 430/440, 446, 430/465

(56) References Cited

U.S. PATENT DOCUMENTS 5,780,209 A * 7/1998 Yamashita ..... 430/399
6,187,520 B1 * 2/2001 Pich et al. ..... 430/434
6,372,417 B1 * 4/2002 Gray et al. ..... 430/440

OTHER PUBLICATIONS

US 5,766,630, 6/1998, Nishio (withdrawn)*

* cited by examiner

*Primary Examiner*—Hoa Van Le
(74) *Attorney, Agent, or Firm*—Muserlian, Lucas and Mercanti

(57) ABSTRACT

A method for processing a silver halide photographic light-sensitive material which comprises a support, a silver halide emulsion layer provided on the support and a hydrophilic colloid layer adjacent to the silver halide emulsion layer, comprising a step of developing the photographic light-sensitive material with a developing solution containing an ascorbic acid compound as a developing agent, wherein the photographic material contains an amine compound in at least one of the silver halide emulsion layer and the hydrophilic colloid layer and an nucleating agent within a range of 0 to 20 mg per 1 $m^2$ of the photographic light-sensitive material, and wherein the amine compound has a distribution coefficient (log P) of 1 or more in a n-octanol/water system.

7 Claims, No Drawings

METHOD FOR PROCESSING SILVER HALIDE LIGHT-SENSITIVE PHOTOGRAPHIC MATERIAL

CROSS-REFERENCE TO RELATED APPLICATIONS

This Application is a Divisional Application of U.S. patent application Ser. No. 09/962,648, filed Sep. 25, 2001 now abandoned and claims the benefit thereof pursuant to 35 U.S.C. 120, which, in turn, claims the benefit of Japanese Priority Application No. 296164/2000, filed Sep. 28, 2000 pursuant to 35 U.S.C. 119.

FIELD OF THE INVENTION

The present invention relates to a method for processing silver halide photographic light-sensitive materials.

BACKGROUND OF THE INVENTION

Heretofore, in the printing field, in order to obtain ultra-high contrast images, lith development has been carried out for the past long years. However, it is inevitable to carry out processing, employing a developer containing a low amount of sulfite salts. As a result, said developer results in problems with stability (aerial oxidation) and has been unsuitable for processing employing an automatic processor.

Separate from this, though ultra-high contrast is not obtained, a so-called "rapid access" system has been employed which improves the stability of the developer by employing a PQ or MQ developer containing a large amount of sulfite salts. However, the quality of halftone dot quality is markedly degraded because an increase in contrast due to the lith development process is not achieved. Accordingly, said system does not sufficiently meet customers' needs who demand high halftone dot quality.

However, said rapid access system exhibits excellent processing stability and has been widely accepted. On the other hand, in order to obtain high contrast (ultra-high contrast) equivalent to that of said lith development, employing said PQ or MQ developer, a system is employed in which processing is carried out employing a PQ or MQ developer at a high pH (approximately 11.5), while nucleating agents such as hydrazine compounds are incorporated into the light-sensitive materials.

Further, by incorporating one of the nucleation accelerators described, for example, in U.S. Pat. No. 5,316,889, or amine compounds described in U.S. Pat. No. 4,947,354 along with active hydrazine compounds into light-sensitive materials, a decrease in the pH of the developer is achieved whereby the system has resulted in improved stability.

In recent years, in the printing field, higher efficiency of work has been sought along with an increase in work volume. Accordingly, it has been demanded that imagewise exposed light-sensitive materials are subjected to more rapid photographic processing. Further, from the viewpoint of environmental protection, a decrease in effluent during photographic processing, resulting from a decrease in replenishment amount, has been an important issue to be overcome.

Accordingly, in order to accomplish the lower replenishment amount as well as said rapid processing, it is required that development is completed in a short time and high processing stability is achieved during high-volume processing. However, in said rapid access system, since high coating of silver is required to obtain a density high enough for carrying out print-in onto a printing plate, in order to, for example, finish development within 50 seconds, the development temperature should be raised to at least 38° C. As a result, a developer is maintained at a relatively high temperature, whereby said developer is degraded, resulting in a decrease in stability.

Further, in said system employing hydrazine compounds, it is possible to constitute a system which results in high density at a low coating weight of silver. However, since it passes through two processes of an induction period and the following reduction sensitization, it is impossible to achieve required development within a short period of time, and further, the processing stability is markedly inferior to said rapid access system.

European Patent No. 0758761 describes a system in which light-sensitive materials do not comprise nucleating agents but comprise amine compounds, and fairly high density is obtained. However, since the PQ and MQ developers are employed, high-volume processing stability has been found to be insufficient when rapid processing is carried out under said low replenishment.

Accordingly, a method has been sought to overcome said drawbacks.

SUMMARY OF THE INVENTION

An objective of the present invention is to provide a method for processing a silver halide photographic light-sensitive material which is applicable to rapid processing at a relatively low temperature, and exhibits excellent sharpness, high sensitivity, as well as excellent stability during high-volume processing.

Said objective of the present invention has been achieved employing items 1 through 10 described below.

(Item 1) A method for processing a silver halide photographic light-sensitive material which comprises a support, a silver halide emulsion layer provided on the support and a hydrophilic colloid layer adjacent to the silver halide emulsion layer, comprising a step of developing the photographic light-sensitive material with a developing solution containing an ascorbic acid compound as a developing agent, wherein the photographic material contains an amine compound in at least one of the silver halide emulsion layer and the hydrophilic colloid layer and an nucleating agent within a range of 0 to 20 mg per 1 $m^2$ of the photographic light-sensitive material, and wherein the amine compound has a distribution coefficient (log P) of 1 or more in a n-octanol/water system.

(Item 2) The method according to the above Item 1, wherein the photographic light-sensitive material contains silver halide grains and 50 percent or more of the silver halide grains in a silver halide emulsion layer are spectrally sensitized.

(Item 3) The method according to the above Item 1, wherein a replenishing amount of the developing solution is 250 ml or less per 1 $m^2$ of the photographic light-sensitive material.

(Item 4) The method according to the above Item 3, the replenishing amount of the developing solution is within the range of 75 to 200 per 1 $m^2$ of the photographic light-sensitive material.

(Item 5) The method according to the above Item 1, wherein the developing is operated under the temperature of 35° C. or less, and developing time is 50 sec or less.

(Item 6) The method according to the above Item 5, wherein the developing is operated under the temperature within the range of 20 to 33° C., and the developing time is within the range of 5 to 15 sec.

(Item 7) The method according to the above Item 1, wherein the developing solution is prepared by dissolving a solidified developer containing the ascorbic acid compound in water.

(Item 8) The method according to the above Item 1, wherein the photographic light-sensitive material contains the amine compound in an amount within the range of 1 to 1000 mg per 1 $m^2$ of the photographic light-sensitive material.

(Item 9) The method according to the above Item 8, wherein the photographic light-sensitive material contains the amine compound in an amount of within the range of 10 to 500 mg per 1 $m^2$ of the photographic light-sensitive material.

(Item 10) The method according to the above Item 10, wherein the photographic light-sensitive material contains the amine compound in an amount of within the range of 20 to 200 mg per 1 $m^2$ of the photographic light-sensitive material.

The present invention will now be detailed below.

In the present invention, A method for processing a silver halide photographic light-sensitive material comprising a support, a silver halide emulsion layer provided on the support and a hydrophilic colloid layer adjacent to the silver halide emulsion layer, comprising a step of developing the photographic light-sensitive material with a developing solution containing an ascorbic acid compound as a developing agent, wherein the photographic material contains an amine compound in at least one of the silver halide emulsion layer and the hydrophilic colloid layer and an nucleating agent within a range of 0 to 20 mg per 1 $m^2$ of the photographic light-sensitive material, and wherein the amine compound has a distribution coefficient (log P) of 1 or more in a n-octanol/water system. By so doing, it has been found that rapid processing is achievable at a relatively low temperature; high sensitivity is maintained even after high-volume processing; excellent sharpness is exhibited; and excellent stability during high-volume processing is also exhibited.

Amine compounds according to the present invention will now be described.

Amine compounds according to the present invention, which has a distribution coefficient (log P) of 1 or more in an n-octanol/water system, are incorporated into a silver halide photographic light-sensitive material which has nucleating agents in an amount within the range of 0 to 20 mg per 1 $m^2$ of the photographic material. The photographic material is processed employing a developing solution comprising ascorbic acid compounds as a developing agent. Thus, it is possible to obtain the effects described in the present invention. Further, by employing the method for processing the silver halide light-sensitive photographic material of the present invention, it is possible to obtain images with high density.

In the present invention, said distribution coefficient (log P) in an n-octanol/water system is defined by General Formula (1) described below.

$$\log P = \log([\text{X octanol}]/[\text{X water}]) \qquad \text{General Formula (1)}$$

wherein X octanol represents the saturation concentration of said amine compound in octanol at 1 atmospheric pressure and 25° C., and X water represents the saturation-concentration of said amine compound in water.

The distribution coefficient (log P), defined by said General Formula (1), of the amine compounds according to the present invention is preferably 1 or more, more preferably 3 or more, and still more preferably 4 or more.

Said log P can be determined and calculated referring to methods described in "Yakubutsu no Kozo Katsusei Sokan (Structure Activity Correlation of Pharmaceuticals)", edited by Kozo Katsusei Sokan Konwakai, Kagaku no Ryoiki, Zokan No. 122, Kohnando, J. Am. Chem. Soc., 86, 5175 (1964), and J. Org. Chem., 32, 2583 (1976).

Preferred structural features of amine compounds having the distribution coefficient (log P) in an n-octanol/water system, as described above, will now be described.

Amine compounds according to the present invention preferably have at least one secondary or one tertiary amino group as well as a group comprised of at least three reiterated ethyleneoxy units. Examples of said compounds are described in U.S. Pat. No. 4,975,354. Further, said ethyleneoxy unit is preferably bonded directly to the nitrogen atom of said tertiary amino group.

Listed as examples of amine compounds according to the present invention are monoamines, diamines, and polyamines. Said amines may be aliphatic amines or may contain an aromatic or heterocyclic portion. Aromatic, aliphatic, and heterocyclic groups in said amines may be substituted or unsubstituted groups. Said amines are preferably compounds having at least 20 carbon atoms.

The amine compounds according to the present invention include compounds represented by General Formula (2), (3), (4), or (5) described below.

$$Y((X)_n—A—B)_m \qquad \text{General Formula (2)}$$

wherein Y represents a group which adsorbs onto silver halide; X represents a divalent bonding group comprised of a hydrogen atom, a carbon atom, a nitrogen atom or a sulfur atom; A represents an alkylene group; B represents an amino group, an ammonium group or a nitrogen-containing heterocyclic group which may be substituted; m represents 1, 2, or 3; and n represents 0 or 1.

$$N(R^1)(R^2)—R^3—(X)_n—SM_y \qquad \text{General Formula (3)}$$

wherein $R^1$ and $R^2$ each represent a hydrogen atom or an aliphatic group, or $R^1$ and $R^2$ may bond to each other to form a ring; $R^3$ represents a divalent aliphatic group; X represents a divalent heterocyclic ring having at least one of a nitrogen atom, an oxygen atom, or a sulfur atom as the hetero atom; n represents 0 or 1; M represents a hydrogen atom, an alkali metal atom, an alkali earth metal atom, a quaternary ammonium, a quaternary phosphonium atom, or amidino group; Y represents an integer of 1 or 2; and when M is a divalent atom, Y is 1. The amine compounds represented by Formula (3) may be in the form of acid addition salts.

In the present invention, bis type tertiary amine compounds, which have a distribution coefficient (log P) of 3 or more and are represented by General Formula (4) described below, are preferably employed.

General Formula (4)

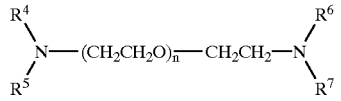

wherein n represents an integer of 3 to 50, and more preferably an integer of 10 to 50; and $R^4$, $R^5$, $R^6$, and $R^7$ each represent an alkyl group having from 1 to 8 carbon atoms, or $R^4$ and $R^5$, and $R^6$ and $R^7$ may bond to each other to form a heterocyclic ring.

In the present invention, further, bis type secondary amine compounds, which have a distribution coefficient (log P) of 3 or more and are represented by General Formula (5) described below, are preferably employed.

General Formula (5)

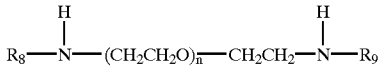

wherein n represents an integer of 3 to 50, and more preferably an integer of 10 to 50; and $R^8$ and $R^9$ each represent an alkyl group having at least 4 carbon atoms.

Specific examples according to the present invention are illustrated below. However, the present invention is not limited to these examples.

AM-1

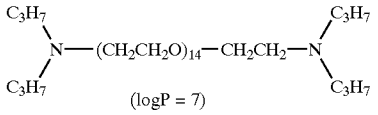

(logP = 7)

AM2

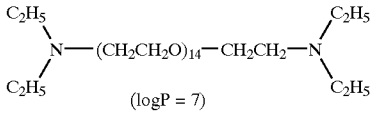

(logP = 7)

AM-3

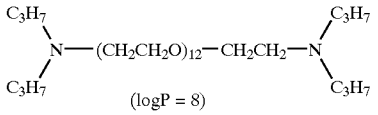

(logP = 8)

AM-4

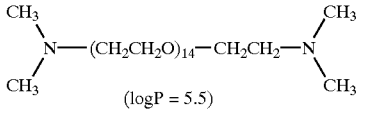

(logP = 5.5)

Further, in the present invention, amine compounds listed in European Patent No. 0,364,166 may be preferably employed.

From the viewpoint to obtain the effects described in the present invention, the added amount of said amine compounds in the silver halide light-sensitive photographic material according to the present invention is preferably from 1 to 1,000 mg/m$^2$, is more preferably from 10 to 500 mg/m$^2$, and is most preferably from 20 to 200 mg/m$^2$.

The nucleating agents according to the present invention will now be described.

In the present invention, the nucleating agents represents a compound which leads to increase contrast of image due to contagious development, when a PQ developing solution or a MQ developing solution is used. Conventionally, hydrazine compounds are used as the nucleating agents. Listed as conventional nucleating agents known in the art are compounds disclosed in Japanese Patent Publication Open to Public Inspection Nos. 62-640, 62-235938, 63-104046, 63-296031, and 64-13545. In the present invention, it is preferable that the light-sensitive photographic material contains the nucleating agent within the range of 0 to 20 mg per m$^2$ of the light-sensitive photographic material. More preferably, the light-sensitive photographic material does not contain the nucleating agent.

Ascorbic acid compounds according to the present invention will now be described.

The ascorbic acid compounds, which are employed in developers and developer replenishers used in the method for processing the silver halide photographic light-sensitive material of the present invention, will now be described.

In the present invention, the term "ascorbic acid compounds" is used to include ascorbic acid, and isomers, derivatives, or salts thereof. Ascorbic acid developing agents have been very well known in said photographic field, and specifically include the compounds described below. However, the present invention is not limited to those described below.

Herein listed are L-ascorbic acid, D-ascorbic acid, L-erythroascorbic acid, D-glucoascorbic acid, 6-deoxy-L-ascorbic acid, L-rhamnoascorbic acid, D-glucoheptaascorbic acid, imino-L-erythroascorbic acid, imino-D-glucoascorbic acid, imino-6-deoxy-L-ascorbic acid, imino-D-glucoheptaascorbic acid, sodium isoascorbate, L-glycoascorbic acid, D-galactoseascrobic acid, L-araboascorbic acid (erythorbic acid), sorboascorbic acid, ascorbic acid and salts thereof. Listed as salts are alkali metal salts such as sodium salts and potassium salts.

In the present invention, it is possible to employ a developer replenisher and a fixer replenisher prepared by employing solid processing agents. The solid processing agents, as described herein, refer to processing agents in the form of powders, tablets, pills, and granules, and if desired, are subjected to a moisture resistance treatment.

The powders, as described herein, refer to aggregates of minute crystals, while said granules refer to grains having a diameter of 50 to 5,000 $\mu$m, which are prepared by applying said powders to a granulation process. The tablets, as described herein, are those which are prepared by applying compression molding to said powders or said granules.

Of said solid processing agents, the tablet agent is preferably employed due to its high replenishment accuracy, as well as ease of handling.

Photographic processing agents may be solidified employing several optimal means. Said means include one in which a concentrated photographic processing solution, or minute powder or grain-shaped photographic processing agents, are kneaded together with water-soluble binders, and the resulting mixture is molded, and another means in which a covering layer is formed in such a manner that a water-soluble binder is sprayed onto the surface of temporarily molded photographic processing agents. (It is advised to refer to Japanese Patent Publication Open to Public Inspection Nos. 4-29136, 4-85535, 4-85536, 4-85533, 4-85534, and 4-172341.)

Preferred methods for producing tablets include a method in which powdered solid processing agents are granulated, and subsequently, molding is carried out employing a tableting process. Solid processing agents produced as above exhibit better solubility and storage stability than that which is produced by simply blending solid processing agent components and molding the resulting mixture employing the tableting process. As a result, said solid processing agents exhibit the advantage in which photographic performance is also stabilized.

Employed as the granulation methods for forming tablets are those known in the art such as rolling granulation, extrusion granulation, compression granulation, crushing granulation, agitation granulation, fluidized-bed granulation, and spray-dry granulation. The average grain diameter of the resulting grains is preferably from 100 to 800 $\mu$m, and is more preferably from 200 to 750 $\mu$m, from the point of view in which non-uniformity of components or so-called segregation rarely occurs when the resulting grains are blended and are subjected to compression under an application of pressure for preparing tablets.

Further, the preferred size distribution is so that at least 60 percent of the resulting granules are in the deviation from ±100 to ±150 μm. Subsequently, the resulting granules are subjected to pressure compression employing compression devices known in the art such as an oil pressure pressing device, a single-tablet type tablet machine, a rotary type tablet machine, and a briquetting machine. Solid processing agents, which are obtained by pressure compression, may be of any desired shape. However, from the viewpoint of productivity as well as ease of handling, and minimization of dust problems in workshop, a cylindrical shape or a so-called tablet shape is preferred.

It is more preferable that each component such as the alkali agent, the reducing agent, the preservative, and the like is individually granulated. By so doing, said effects are more pronounced.

It is possible to produce tablet processing agents employing common methods described, for example, in Japanese Patent Publication Open to Public Inspection Nos. 51-61837, 54-155038, and 52-88025; and British Patent No. 1,213,808. Further, it is possible to produce granular processing agents employing common methods described, for example, in Japanese Patent Publication Open to Public Inspection Nos. 2-109042, 2-109043, 3-39735, and 3-39739. Still further, it is possible to produce powder processing agents employing common methods, described, for example, in Japanese Patent Publication Open to Public Inspection No. 54-133332; British Patent Nos. 725,892 and 729,862; and German Patent No. 3,733, 861.

From the viewpoint of solubility and the effects of the objective of the present invention, in the case of tablet agents, the apparent density of said solid processing agents is preferably from 1.0 g to 2.5 g/cm$^3$. An apparent density of no less than 1.0 g/cm$^3$ is preferred from the point of strength of the obtained solid materials, while said density of no more than 2.5/cm$^3$ is preferred from the point of solubility of the obtained solid materials. When solid processing agents are granular or powder, the apparent density is preferably from 0.40 to 0.95 g/cm$^3$.

Solid processing agents are preferably employed as a developer. Further, they may be employed as other photographic processing agents such as fixing agents and rinsing agents. Further, developers as well as fixing agents can be excluded from the liquid hazardous substance regulation. It is most preferable that all processing agents be comprised of solid processing agents. However, it is preferable that at least developers and fixing agents are comprised as solids.

Only one component of the processing agent may be solidified. Preferably, however, all components are solidified. It is preferable that each component be individually molded as a solid processing agent and be individually packaged. Further it is preferable that each component is packaged in the order in which they are repeatedly charged.

When processing agents are solidified, all alkali agent and reducing agent are preferably prepared as solid processing agents. Further, when prepared as tablets, one tablet is comprised of at most three agents, but most preferably, one tablet is comprised of only one agent. Further, when solid processing agents are prepared by dividing at least two agents, a plurality of resulting tablets or granules is included in the same package.

When a fixing agent is solidified, it is preferable that all of the main fixing agents, preservatives, and hardening agents such as aluminum salts are solidified. In the case of tablets, one tablet is comprised of at most three agents, and more preferably, one tablet is comprised of one agent or two agents. Further, when a solid processing agent is prepared by dividing into at least two agents, a plurality of these tablets or granules are preferably included in the same package. Specifically, from the viewpoint of handling, it is preferable that aluminum salts are solidified.

Listed as packaging materials of solid processing agents are polyethylene (prepared by either a high or a low pressure method), polypropylene (either stretched or unstretched), polyvinyl chloride, polyvinyl acetate, nylon (either stretched or unstretched), polyvinylidene chloride, polystyrene, polyvinyl carbonate, vinylon, eval, polyethylene terephthalate (PET), other polyesters, hydrochlorinated rubber, acrylonitrile-butadiene copolymers, synthetic resin components such as epoxy-phosphoric acid based resins (polymers described in Japanese Patent Publication Open to Public Inspection No. 63-63037, and polymers described in Japanese Patent Publication Open to Public Inspection No. 57-32952), and pulp.

It is preferable that said components be individually employed. When employed as a film, films may be adhered through lamination, or may be employed as the coating layer. Further, said film may be used individually.

Further, it is more preferable that various types of gas barrier layers be employed in such a manner that, for example, an aluminum foil is provided between said synthetic resinous films, or aluminum evaporated synthetic resinous films are employed.

Still further, in order to improve the storage stability of said solid processing agents, as well as to minimize stain formation, the oxygen permeability of said packaging materials is preferably no more than 50 ml/m$^2$·atmosphere (at 20° C. and 66 percent relative humidity), and is more preferably no more than 30 ml/m$^2$·atmosphere.

The total thickness of said laminated layers or single layer is preferably from 1 to 3,000 μm, is more preferably from 10 to 2,000 μm, and still more preferably from 50 to 1,000 μm.

Said synthetic resinous film may be comprised of one (polymer) resinous layer, but may also be comprised of at least two laminated layers comprised of (polymer) resinous layers.

When processing agents are packaged employing water-soluble film, and are bound employing water-soluble binding agents or covered with the same, said water-soluble films or water-soluble binders are preferably comprised of polyvinyl alcohol based, methyl cellulose based, polyethylene oxide based, starch based, polyvinylpyrrolidone based, hydroxypropyl cellulose based, pullulan based, dextran based or gum Arabic based, polyvinyl acetate based, hydroxyethyl cellulose based, carboxymethyl cellulose based, carboxymethyl hydroxyethyl cellulose sodium salt based, poly(alkyl) oxazoline based, and polyethylene glycol based components. Of these, specifically, polyvinyl alcohol based and pullulan based components are preferably employed from the point of view of their covering or binding effects.

From the viewpoint of the storage stability of solid processing agents, the dissolving time of said water-soluble film, and crystal deposition in the automatic processor, the thickness of said water-soluble film is preferably from 10 to 120 μm, is more preferably from 15 to 80 μm, and is most preferably from 20 to 60 μm.

In addition, said water-soluble film is preferably thermoplastic. The resulting thermoplasticity not only renders a heat seal treatment and ultrasonic fusion treatment easy, but also makes it possible to more preferably exhibit covering effects.

Further, the tensile strength of said water-soluble film is preferably from $4.9\times10^6$ to $490\times10^6$ N/M$^2$, is more preferably from $9.8\times10^6$ to $245\times10^6$ N/m$^2$, and is most preferably from $14.7\times10^6$ to $98\times10^6$ N/m$^2$. Said tensile strength is determined employing the method described in JIS Z-1521.

Further, in order to minimize damage due to contact with moisture in the atmosphere such as high humidity, rain or fog, and sudden contact with scattered water or wet hands during the storage, transportation and handling of photographic processing agents, which have been packaged with water-soluble film or are bound with water-soluble binders, said photographic processing agents are preferably packaged with moisture-resistance packaging materials. The thickness of said moisture-resistant packaging materials is preferably from 10 to 150 $\mu$m. Said material is preferably one which is selected from polyolefin films such as polyethylene terephthalate, polyethylene, polypropylene, kraft paper capable of having moisture resistant effects employing polyethylene, waxed paper, water-resistant cellophane, glassine, polycarbonate, polystyrene, polyvinyl chloride, polyvinylidene chloride, polyamides, polycarbonates, acrylonitrile based and metal foil such as aluminum, and metalized polymer film. Said materials may be composite materials of these. Further, preferably employed as said water-resistant packaging materials are degradable plastics, especially biodegradable or photodegradable plastics.

Cited as said biodegradable plastics are those comprised of natural polymers, microorganism generating polymers, easily biodegradable synthetic polymers, and plastics blended with biodegradable natural polymers. Listed as photodegradable plastics are those having, in the main chain, groups which result in bond breakage upon excitation by ultraviolet rays. In addition to those listed above, preferably employed may be those which simultaneously result in photodegradation and biodegradation.

Specific examples of said representative compounds will now be listed below.

Biodegradable plastics include:

(a) natural polymers: polysaccharides, cellulose, polylactic acid, chitin, chitosan, polyamino acid, or modified compounds thereof;

(b) microorganism generating polymers: PHB-PHV (being a copolymer of 3-hydroxybutylate and 3-hydroxyvalerate), and microorganism generating cellulose;

(c) easily biodegradable synthetic polymers: polyvinyl alcohol and polycaprolactone, or copolymers or mixtures thereof;

(d) plastics blended with biodegradable natural polymers: easily biodegradable natural polymers include starch and cellulose, which are added to plastics so as to result in shape disintegration properties; and as photodegradable plastics, (e) introduction of a carbonyl group for photodecomposition.

Further, UV absorbers may be added to accelerate the disintegration.

Employed as said degradable plastics may be those which are generally described in "Kagaku to Kogyo (Science and Industry)", Volume 64, No. 10, pages 478 to 484 (1990), "Kino Zairyo (Functional Materials)", July Issue, 1990, pages 23 to 34. Further, it is possible to employ commercially available degradable plastics such as Biopol (manufactured by ICI, Eco (manufactured by Union Carbide Co., Ecolite (manufactured by Eco Plastic Co.), Ecostar (manufactured by St. Lawrence Starch Co.), and Nackle P (manufactured by Nippon Unicar Co.).

The moisture permeability of said moisture resistant packaging materials is preferably no more than 10 g·mm/m$^2$·24 hours, and is more preferably no more than 5 g·mm/m$^2$·24 hours.

In combination with ascorbic acid compounds (said ascorbic acid, and erythorbic acid) according to the present invention, it is preferred to employ auxiliary developers such as 3-pyrazolidones (for example, 1-phenyl-3-pyrazolidone, 1-phenyl-4-methyl-3-pyrazolidone, 1-phenyl-4,4-dimethyl-3-pyrazolidone, 1-phenyl-4-ethyl-pyrazolidone, and 1-phenyl-5-methyl-3-pyrazolidone), as well as aminophenols (for example, o-aminophenol, p-aminophenol, N-methyl-o-aminophenol, N-methyl-p-aminophenol, and 2,4-diaminophenol). In this case, developing agents such as 3-pyrazolidones and aminophenols are preferably employed in an amount of 0.001 to 1.4 moles per liter of developer. Further, said ascorbic acid compounds (ascorbic acid, and erythorbic acid) are preferably employed in an amount of 0.05 to 1 mole per liter of developer.

Further, it is possible to employ dihydroxybenzene based developing agents in combination. Listed as said dihydroxybenzene based developing agents are, for example, hydroquinone, chlorohydroquinone, bromohydroquinone, isopropylhydroquinone, methylhydroquinone, 2,3-dochlorohydroquinone, and 2,5-dimethylhydroquinone. Of these, hydroquinone is most commonly employed. These are commonly employed in an amount of 0.08 to 0.3 mole per liter of developer, and are preferably employed in an amount of 0.1 to 0.25 mole.

<<Processing>>

In the method for processing the silver halide light-sensitive photographic materials of the present invention, after the fixing step, said light-sensitive materials are washed with water and/or processed in a stabilizing bath. Said stabilizing bath is employed for stabilizing images upon adjusting the pH (3 to 8 after processing) of the layer. Accordingly, said stabilizing bath comprises inorganic and organic acids and salts thereof, or alkali agents and salts thereof (for example, borates, metaborates, borax, phosphates, carbonates, potassium hydroxide, sodium hydroxide, ammonia water, monocaroxylic acid, dicarboxylic acid, polycarboxylic acids, citric acid, oxalic acid, malic acid, and acetic acid are employed in combination). In addition, said stabilizing bath comprises aldehydes (for example, formalin, glyoxal, and glutaraldehyde); chelating agents (for example, ethylenediaminetetraacetic acid or alkali metal salts thereof, nitrilotriacetates and polyphosphates); antifungal agents (for example, phenol, 4-chlorophenol, cresol, o-phenylphenol, chlorophene, dichlorophene, formaldehyde, p-hydroxybenzoic acid ester, 2-(4-thiazoline)-benzimidazole, benzoisothiazoline-3-one, dodecyl-benzyl-ammonium-chloride, N-(fluorodichloromethylthio)phthalimide, and 2,4,4'-trichloro-2'-hydroxydiphenylether); image color control agents and/or remaining color improving agents (for example, heterocyclic ring containing compounds having a mercapto group as the substituent specifically including sodium 2-mercapto-5-sulfonate-benzimidazole, 1-phenyl-5-mercaptotetrazole, 2-mercaptobenzthiazole, 2-mercapto-5-propyl-1,3,4-triazole, and 2-mercaptohypoxanthine). Of these, antifungal agents are preferably incorporated into said stabilizing bath. These may be replenished in either liquid or solid form. In the solid form when replenished, it is possible to employ the method for producing solid processing agents as well as the method for using the same, described below.

When the silver halide photographic light-sensitive materials according to the present invention are subjected to photographic processing after exposure, it is preferable that development is carried out at no higher than 35° C. for no more than 50 seconds. From the viewpoint of rapid processing, the development time is preferably no more than 20 seconds, is more preferably 15 seconds, and is most preferably from 5 to 15 seconds. The development temperature is more preferably no higher than 33° C., and is most preferably from 20 to 33° C.

When the development temperature exceeds 35° C., problems may occur in which ascorbic compounds employed as developing agents tend to become unstable.

Further, in the method for processing silver halide light-sensitive materials of the present invention, said processing is carried out in such a manner that a definite amount of the developer, proportional to the processed area, is replenished. In order to decrease the effluent volume,: the replenishment rate of the developer replenisher is preferably no more than 250 ml per $m^2$, and is more preferably from 75 to 200 ml per $m^2$ of the photographic material.

The silver halide emulsion layers employed in the silver halide light-sensitive photographic materials according to the present invention will now be described.

The halogen composition of silver halide employed in said light-sensitive materials is preferably silver chlorobromide or silver iodobromide having a silver chloride content ratio of 50 to 85 mole percent. The average grain size of silver halide grains is preferably no more than 0.7 $\mu$m, and is most preferably from 0.3 to 0.1 $\mu$m. The shape of silver halide grains may be tabular, spherical, cubic, tetrahedral, octahedral, and other shapes. Further, the grain size distribution is preferably narrow, and specifically, a so-called monodispersed emulsion is preferred in which 90 percent, and preferably 95 percent, of total grains are included within ±40 percent of the average grain size.

In at least one of the formation process or the growth process of silver halide grains, Group 8 metal salts such as cadmium salts, zinc salts, lead salts, thallium salts, ruthenium salts, osmium salts, iridium salts, or rhodium salts, or complex salts containing these elements are preferably added, and of these, rhodium salts and ruthenium salts are particularly preferred. The added amount is preferably from $10^{-8}$ to $10^{-4}$ mole per mole of silver.

Silver halide emulsions and their preparation methods are detailed in Research Disclosure (RD) Volume 176, Item 17643, pages 22 and 23 (December 1978) or references cited therein.

Silver halide emulsions are preferably chemically sensitized. Further, said silver halide emulsions may be spectrally sensitized to the desired wavelength employing sensitizing dyes. Preferably, 50% or more of the silver halide grains in the silver halide emulsion are chemically sensitized.

Preferably employed as sensitizing dyes for said spectral sensitization is at least one of the sensitizing dyes represented by General Formulas (6) through (11) described below.

General Formula (6)

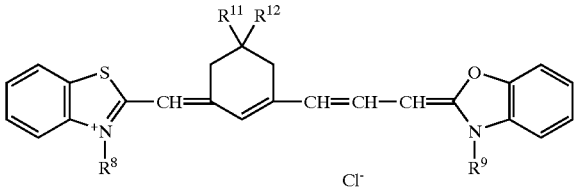

-continued

General Formula (7)

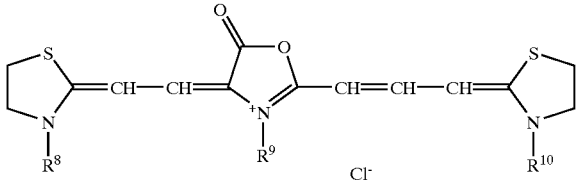

General Formula (8)

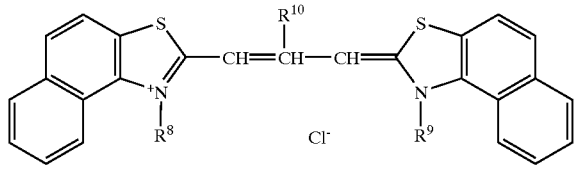

General Formula (9)

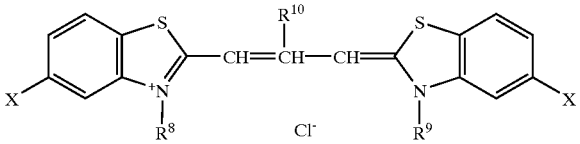

General Formula (10)

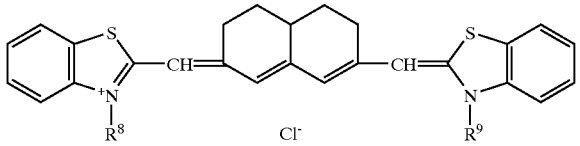

General Formula (11)

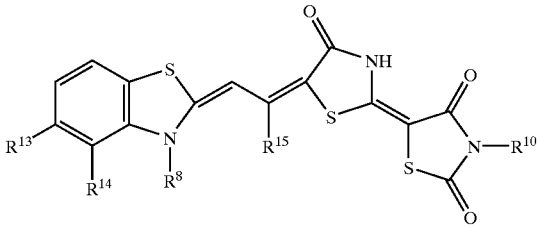

wherein $R^8$, $R^9$, and $R^{10}$ each represent an acid water-solubilizing group such as an alkyl group substituted with a carboxyl group or a sulfone group; $R^{11}$ and $R^{12}$ each represent an alkyl group having from 1 to 4 carbon atoms; $R_{13}$, $R^{14}$, and $R^{15}$ each represent a hydrogen atom, a substituted or unsubstituted alkyl group, or a substituted or unsubstituted aryl group; and X represents a halogen atom (for example, a chlorine atom, a bromine atom, a fluorine atom or an iodine atom).

The silver halide light-sensitive photographic materials according to the present invention will now be described.

Said silver halide light-sensitive photographic materials according to the present invention comprise a support having thereon silver halide emulsion layers. It is preferable that one of the surfaces of said support is provided with an antihalation layer, and further, said antihalation layer is provided on the support surface opposite to said emulsion layers.

Further, said photographic materials according to the present invention preferably comprise a hydrophilic colloidal layer other than said silver halide emulsion layers. Said hydrophilic colloidal layer refers to a layer comprising gelatin, hydrophilic binders, and water-soluble binders, and for example, a protective layer, a backing layer, or the like is one of the embodiments of said hydrophilic colloidal layer.

Antihalation dyes are incorporated into said backing layer. Said dyes are added to said backing layer under a dissolved state and/or a dispersed state. Listed as suitable dyes are those described in Research Disclosure Item 308119.

For the purpose of minimizing fog during the production processes, storage, or photographic processing, or of the stabilizing photographic performance, it is possible to add to said light-sensitive materials according to the present many compounds known as an antifoggant or stabilizer. Said photographic emulsions and light-nonsensitive hydrophilic colloids may comprise inorganic or organic hardeners. For various purposes such as improvement of the coating, minimization of static charge, improvement of lubricating properties, improvement of emulsion dispersion, minimization of adhesion, and improvement of general photographic characteristics, it is possible to employ various types of surface active agents known in the art into the light-sensitive emulsion layers and/or light-insensitive hydrophilic colloidal layers.

It is advantageous to employ gelatin as the binder or the protective colloid of said photographic emulsions. However, it is possible to employ hydrophilic colloids other than gelatin.

For the purpose of improving dimensional stability, in the photographic emulsions employed in the present invention, used individually or in combination may be for example, alkyl acrylate, alkyl methacrylate, alkoxyacryl acrylate, alkoxyacryl methacrylate, glycidyl acrylate, glycidyl methacrylate, acrylamide, methacrylamide, vinyl ester (for example, vinyl acetate), acrylonitrile, olefin, styrene, or any of polymers having, as the monomer component, a combination of acrylic acid, methacrylic acid, α,β-unsaturated dicarboxylic acid, hydroxyalkyl acrylate, hydroxyalkyl methacrylate, sulfoalkyl acrylate, sulfoalkyl methacrylate, and styrenesulfonic acid with any of said compounds.

It is preferable that in the light-sensitive materials which are processed employing the method for processing the silver halide light-sensitive materials of the present invention, at least one electrically conductive layer is provided on the support. Representative methods for forming said electrically conductive layer include those in which said layer is formed by employing water-soluble electrically conductive polymers as well as hydrophobic polymer hardeners and in which metal oxides are employed. Listed as said methods are those described, for example, in Japanese Patent Publication Open to Public Inspection No. 3-265842.

When the swelling percentage of the light-sensitive materials processed utilizing the present invention is preferably from 30 to 250 percent, and more preferably from 50 to 180 percent, it is possible to exhibit the desired effects of the present invention. The swelling percentage, as described herein, refers to the swelling ratio represented by $(d-d_0)/d\times 100$, wherein do is the thickness of the hydrophilic colloidal layer of a light-sensitive material which has been subjected to an incubation treatment at 38° C. and 50 percent relative humidity for three days, and d is the thickness of the hydrophilic colloidal layer of said light-sensitive material which has been immersed at 21° C. for 3 minutes.

It is possible to apply various techniques as well as additives known in the photographic art to silver halide emulsions. These are described in said RD Volume 176, Item 7643 (December 1987) as well as Volume 187, Item 8716 (November 1979).

In the light-sensitive materials employed in the present invention, each of the emulsion layers as well as the protective layer may be comprised of a single layer or a multilayer comprised of at least two layers. In the case of a multilayer, interlayers may be provided between layers.

Listed as usable supports may be those comprised of polyesters such as cellulose acetate, cellulose nitrate, and polyethylene terephthalate; polyolefin such as polyethylene; polystyrene; baryta paper; paper coated with polyolefin; glass; and metal. If desired, these supports may be subjected to a subbing treatment.

EXAMPLES

The present invention is detailed with reference to examples. However, the present invention is not to be construed as being limited to these examples.

Example 1

<<Preparation of Silver Halide Emulsion>>

Silver halide grains having a silver chloride content ratio of 70 percent and a silver bromide content ratio of 30 percent were allowed to grow by mixing an aqueous silver nitrate solution with an aqueous mixture solution of sodium chloride and potassium bromide, utilizing a double-jet method. During grain growth, ammonium hexachlororhodate was added in an amount of $1.5\times10^{-7}$ mole per mole of silver, whereby a monodispersed cubic silver chlorobromide emulsion having a dope edge length of 0.22 μm was prepared. After adjusting the pH of the resulting emulsion to the specified value by adding citric acid, the pAg was also adjusted to the specified value by adding potassium bromide. Subsequently, chloroauric acid and flower of sulfur were added in an amount of 5 mg, and 0.5 mg per mole of silver, respectively, followed by being subjected to chemical sensitization at 52° C. for 50 minutes. After ripening, 4-hydroxy-6-methyl-1,3,3a,7-tetraazaindene was added in an amount of 300 mg per mole of silver, and the resulting emulsion was then cooled to 40° C. Subsequently, Spectral Sensitizer S1 and potassium iodide were added in an amount of $4\times10^{-}4$ mole per mole of silver, and 250 mg per mole of silver, respectively.

<<Preparation of Silver Halide Light-Sensitive Photographic Materials>>

Simultaneously applied onto one of the sublayers of a 100 μm thick polyethylene terephthalate film, which had been subjected to formation of a 0.1 μm thick sublayer (refer to Example 1 of Japanese Patent Publication Open to Public Inspection No. 59-19941) on both sides, coating compositions of Formulas (1) through (3) described below in that order from the sublayer. Further, applied onto the opposite sublayer was the backing layer coating composition prepared by Formula (4), described below, was to obtain a coating weight of gelatin of said backing layer of 2.0 g/m$^2$, and subsequently, the protective layer coating composition of Formula (5), described below, was applied onto said backing layer to obtain a gelatin coating weight of 1.0 g/m$^2$.

| [Hydrophilic Colloidal Layer Formula (1)] | |
|---|---|
| Gelatin | 0.5 g/m$^2$ |
| Saponin (surface active agent) | 0.1 g/m$^2$ |
| [Silver Halide Emulsion Layer Formula (2)] | |
| Gelatin | 1.0 g/m$^2$ |
| Silver halide emulsion silver weight | 2.3 g/m$^2$ |
| Amine Compound AM-1 | 60 mg/m$^2$ |
| Polymer Latex PL | 0.5 g/m$^2$ |
| Colloidal Silica | 0.25 g/m$^2$ |
| Hydroquinone | 0.13 g/m$^2$ |

-continued

| | |
|---|---|
| Water-Soluble Polymer V-1 | 20 mg/m$^2$ |
| Saponin (surface active agent) | 0.08 g/m$^2$ |
| [Silver Halide Emulsion Protective Layer Formula (3)] | |
| Gelatin | 1.15 g/m$^2$ |
| Polymethyl methacrylate beads having an average grain diameter of 3.5 μm (matting agent) | 30 mg/m$^2$ |
| Sodium di(2-ethyl hexyl)sulfonate | 10 mg/m$^2$ |
| Surface Active Agent S-1 | 0.6 mg/m$^2$ |
| Hardener HA-1 | 150 mg/m$^2$ |
| [Backing Layer Formula (4)] | |
| Gelatin | 2.0 g/m$^2$ |
| Dye F-1 | 50 mg/m$^2$ |
| Dye F-2 | 40 mg/m$^2$ |
| Colloidal SIlica | 0.3 g/m$^2$ |
| Hardener HA-1 | 0.1 g/m$^2$ |
| Hardener K | 0.08 g/m$^2$ |
| [Backing Protective Layer Formula (5)] | |
| Gelatin | 1.0 g/m$^2$ |
| Polymethyl methacrylate beads having an average grain diameter of 4.0 μm (matting agent) | 50 mg/m$^2$ |
| Sodium di(2-ethyl hexyl)sulfonate | 10 mg/m$^2$ |
| Hardener HA-2 | 150 mg/m$^2$ |
| Hardener HA-3 | 100 mg/m$^2$ |

Spectral Sensitizer S1

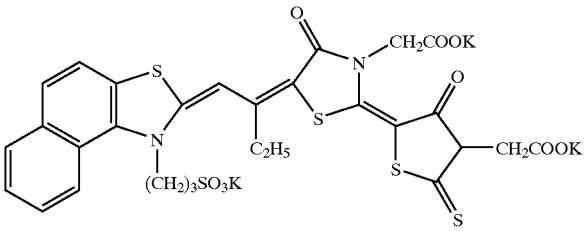

S-1

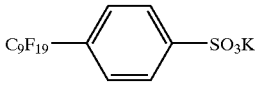

HA-1

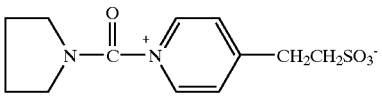

HA-2

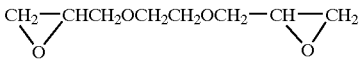

HA-3

$C(CH_2SO_2CH{=}CH_2)_4NH_2CH_2CH_2SO_3K$

K

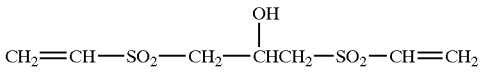

F-1

-continued

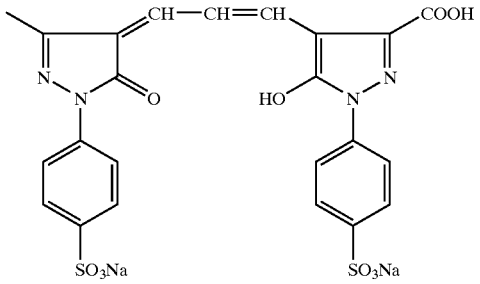

F-2

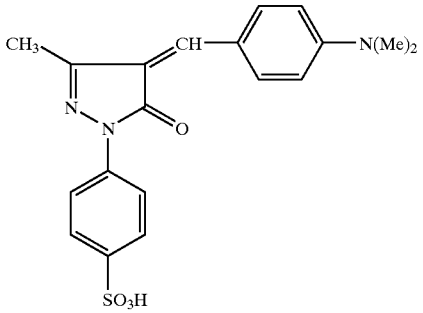

Polymer Latex PL

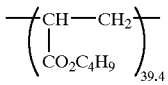

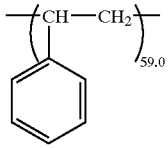

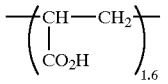

V-1

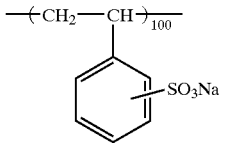

<<Preparation of Solid Developer>>

(Preparation of Solid Developer (D-1))

(1) Preparation of Granular Developing Agent DA

Blending of Components (to Make 1 Liter of a Working Solution)

| | |
|---|---|
| Sodium erythorbate | 60 g |
| Dimezone S | 1.45 g |
| N-acetylpenicillamine | 0.25 g |
| DTPA.5H | 2 g |
| KBr (sized into mesh 0.25 mm employing a commercially available sizer) | 4 g |

-continued

| | |
|---|---|
| Benzotriazole | 0.21 g |
| Sorbitol | 4 g |
| 1-Phenyl-5-mercaptotetrazole | 0.05 g |
| Sodium sulfite | 15 g |

The above components were blended employing a commercially available V type blender (having a capacity of 200 liters) for 10 minutes.

(2) Molding Process

Said blend was molded at a pocket shape of 5.0 mmΦ×1.2 mm (in depth), a roller rotation frequency of 15 rpm, and a feeder rotation frequency of 24 rpm, employing a compression granulator, Briqueter BSS-IV type, manufactured by Shinto Kogyo Co., Ltd. The resulting plate-shaped mold was cracked employing a classifier, and was divided into granules at a size of 2.4 to 7.0 mm, and minute powdered grains at a size of no more than 2.4 mm (granules at a size of no less than 7.0 mm were cracked). Further, minute powdered grains at a size of no more than 2.4 mm were blended with said mixture, returned to said compression granulator, and then molded.

(2) Preparation of Carbonate Salt (DB) (to Make 1 Liter)

| | |
|---|---|
| Potassium carbonate | 70 g |
| Sodium octanesulfonate | 0.5 g |

Said raw materials were blended employing a blender.

(3) Packaging (a kit to Make 10 Liters of a Working Solution)

A 1-liter polyethylene capped bottle-shaped vessel was filled with said molded granules and alkali agents in the order described below. Further, in order to minimize deterioration due to aerial oxidation, 10 liters of nitrogen gas was forced into said vessel and capped, whereby a packaged solid processing agent was prepared.

| | |
|---|---|
| (a) DB | 705 g |
| (b) DA | 966 g |

The solid processing agent as prepared above was dissolved while stirring in 9 liters of water, and finally the total volume was adjusted 10 liters, while adjusting the pH to 10.0 by adding sodium hydroxide.

<<Preparation of Comparative Solid Developer D-2>>

(1) Preparation of Granular Developing Agent EA (Pretreatment of Components)

Hydroquinone was pulverized in an 8 mm mesh and a rotation frequency of 25 Hz, employing a pulverizer, Mikro-Pulverizer AP-B, manufactured by Hosokawa Mikron Co., Ltd.

(Blending of Components (to Make 1 Liter of a Working Solution)

| | |
|---|---|
| Hydroquinone | 25 g |
| Dimezone S | 1.0 g |
| N-acetylpenicillamirie | 0.25 g |
| DTPA.5H | 2 g |
| KBr (sized into mesh 0.25 mm employing a commercially available sizer) | 4 g |

-continued

| | |
|---|---|
| Benzotriazole | 0.21 g |
| Sorbitol | 4 g |
| 1-Phenyl-5-mercaptotetrazole | 0.05 g |
| Sodium sulfite | 55 g |

The above components were blended employing a commercially available V type blender (having a capacity of 200 liters) for 10 minutes.

(2) Molding Process

Said blend was molded at a pocket shape of 5.0 mmΦ×1.2 mm (in depth), a roller rotation frequency of 15 rpm, and a feeder rotation frequency of 24 rpm, employing a compression granulator, Briquetter BSS-IV type, manufactured by Shinto Kogyo Co., Ltd. The resulting plate-shaped mold was cracked employing a classifier, and was divided into granules at a size of 2.4 to 7.0 mm and minute powdered grains at a size of no more than 2.4 mm (granules at a size of no less than 7.0 mm were recracked). Further, minute powdered grains at a size of no more than 2.4 mm were blended with said mixture, returned to said compression granulator, and then molded.

(2) Preparation of Carbonate Salt (EB) (to Make 1 Liter)

| | |
|---|---|
| Potassium carbonate | 70 g |
| Sodium octanesulfonate | 0.5 g |

Said raw materials were blended employing a blender.

(3) Packaging (a kit to Make 10 Liters of a Working Solution)

A 1-liter capped polyethylene bottle-shaped vessel was filled with said molded granules and alkali agents in the order described below. Further, in order to minimize deterioration due to aerial oxidation, 10 liters of nitrogen gas was forced into said vessel and capped, whereby a packaged solid processing agent was prepared.

| | |
|---|---|
| (a) EB | 705 g |
| (b) EA | 915 g |

The solid processing agent as prepared above was dissolved while stirring in 9 liters of water, and finally the total volume was adjusted 10 liters while adjusting the pH to 10.4 by adding sodium hydroxide.

A fixer was prepared by diluting Type 881, manufactured by Konica Corp., by a factor of 5 and employed.

Each of the silver halide light-sensitive photographic materials, prepared as above, was exposed employing FTR-3050, manufactured by Dainippon Screen Co., Ltd. Each exposed material was processed under processing conditions described below, employing LD-T1060 Automatic Processor, manufactured by Dainippon Screen Co., Ltd., which had been modified so that development was achievable within 10 seconds, whereby Processed Samples 1 through 14 were prepared.

(Processing Conditions)

Development: under conditions shown in Table 1, the developer replenishment rate was adjusted to 120 ml/$m^2$ Fixing: adjusted to 32 C. and fixer replenishment rate was adjusted to 200 ml/$m^2$ Washing: adjusted to room temperature and the rate of washing water was adjusted to 4 liters/minute Drying: adjusted to 45° C.

<<Evaluation of Sensitivity and Sharpness of Halftone Dots>>

Step exposure was performed employing a laser sensitometer utilizing a 660 nm He—Ne laser as the light source, while varying the light amount at $1.5\times10^{-7}$ second, and each exposed sample was subjected to photographic processing under the conditions previously described. Density of each processed sample was determined employing PDA-65 (being a Konica Digital Densitometer). Sensitivity in Table 1 is expressed by the relative sensitivity when the sensitivity at a density of 2.5 of Sample No. 4 is 100. Further, sharpness was visually evaluated by observing halftone dots which gave 50 percent halftone dot density, employing a 100 power magnifying lens. The highest rank was denoted as 5, while the lowest rank was denoted as 1. Rank 3 was assigned as the lower limit for commercial viability. Decimal points were used between ranks.

TABLE 1

| Processed Sample No. | Development Temperature ° C. | Development Time seconds | Developer | Fresh Solutions Sensitivity | Fresh Solutions Sharpness | High-Volume Processed Solution Sensitivity | High-Volume Processed Solution Sharpness | Remarks |
|---|---|---|---|---|---|---|---|---|
| 1 | 40 | 30 | D-1 | 118 | 4.5 | 120 | 4.5 | Inv. |
| 2 | 38 | 30 | D-1 | 111 | 4.75 | 110 | 4.75 | Inv. |
| 3 | 35 | 30 | D-1 | 105 | 4.75 | 104 | 4.75 | Inv. |
| 4 | 35 | 60 | D-1 | 110 | 4.75 | 110 | 4.75 | Inv. |
| 5 | 33 | 30 | D-1 | 100 | 5 | 101 | 5 | Inv. |
| 6 | 33 | 20 | D-1 | 96 | 5 | 96 | 5 | Inv. |
| 7 | 33 | 15 | D-1 | 90 | 4.75 | 89 | 4.75 | Inv. |
| 8 | 40 | 30 | D-2 | 130 | 3.75 | 102 | 2.5 | Comp. |
| 9 | 38 | 30 | D-2 | 121 | 4 | 90 | 2.5 | Comp. |
| 10 | 35 | 30 | D-2 | 102 | 4.5 | 86 | 3 | Comp. |
| 11 | 35 | 60 | D-2 | 122 | 3.75 | 110 | 3 | Comp. |
| 12 | 33 | 30 | D-2 | 100 | 4.5 | 86 | 3. | Comp. |
| 13 | 33 | 20 | D-2 | 85 | 3 | 45 | 1.25 | Comp. |
| 14 | 33 | 15 | D-2 | 62 | 2.5 | 21 | 1 | Comp. |

Inv.: Present Invention,
Comp.: Comparative Example

As can clearly be seen from Table 1, compared to comparative samples, the samples of the present invention were applicable to rapid processing at a relatively low temperature, and exhibit excellent sharpness and high sensitivity, as well as excellent stability during high-volume processing.

Effects of the Invention according to the present invention, it has become possible to provide a method for processing silver halide light-sensitive photographic materials which is applicable to rapid processing at a relatively low temperature, and exhibits excellent sharpness and high sensitivity, as well as excellent stability during high-volume processing.

What is claimed is:

1. A method for processing a silver halide photographic light-sensitive material which comprises a support, a silver halide emulsion layer provided on the support and a hydrophilic colloid layer adjacent to the silver halide emulsion layer, the method comprising:

developing the photographic light-sensitive material with a developing solution containing an ascorbic acid compound as a developing agent under a temperature within a range of 20 to 33° C. in a developing time within a range of 5 to 15 seconds, wherein the photographic material contains an amine compound in at least one of the silver halide emulsion layer and the hydrophilic colloid layer and contains no nucleating agent, and the amine compound is represented by General Formula (4):

General Formula (4)

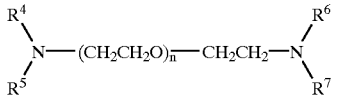

wherein n represents an integer of 3 to 50, and more preferably an integer of 10 to 50; and $R^4$, $R^5$, $R^6$ and $R^7$ each represent an alkyl group having from 1 to 8 carbon atoms, or $R^4$ and $R^5$, and $R^6$ and $R^7$ may bond to each other to form a heterocyclic ring.

2. The method of claim 1, wherein the silver halide emulsion layer contains silver halide grains and 50 percent or more of the silver halide grains are spectrally sensitized.

3. The method of claim 1, wherein the replenishing amount of the developing solution is within a range of 75 to 200 ml per 1 $m^2$ of the photographic light-sensitive material.

4. The method of claim 1, wherein the photographic light-sensitive material contains the amine compound within a range of 1 to 1000 mg per 1 $m^2$ of the photographic light-sensitive material.

5. The method of claim 4, wherein the photographic light-sensitive material contains the amine compound within a range of 10 to 500 mg per 1 $m^2$ of the photographic light-sensitive material.

6. The method of claim 5, wherein the photographic light-sensitive material contains the amine compound within a range of 20 to 200 mg per 1 $m^2$ of the photographic light-sensitive material.

7. A method for processing a silver halide photographic light-sensitive material which comprises a support, a silver halide emulsion layer provided on the support and a hydrophilic colloid layer adjacent to the silver halide emulsion layer, the method comprising:

dissolving a tablet containing an ascorbic acid compound as a developing agent so as to prepare a developing solution;

developing the photographic light-sensitive material with the developing solution under a temperature within a range of 20 to 33° C. in a developing time within a range of 5 to 15 seconds, wherein the photographic material contains an amine compound in at least one of the silver halide emulsion layer and the hydrophilic colloid layer and contains no nucleating agent, and the amine compound is represented by General Formula (4):

General Formula (4)

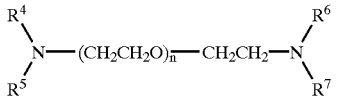

wherein n represents an integer of 3 to 50, and more preferably an integer of 10 to 50; and $R^4$, $R^5$, $R^6$ and $R^7$ each represent an alkyl group having from 1 to 8 carbon atoms, or $R^4$ and $R^5$, and $R^6$ and $R^7$ may bond to each other to form a heterocyclic ring.

* * * * *